US008250931B2

(12) United States Patent
Young et al.

(10) Patent No.: US 8,250,931 B2
(45) Date of Patent: Aug. 28, 2012

(54) METHODS AND COMPOSITIONS FOR INHIBITING CORROSION IN NON-AQUEOUS, NON-CONDUCTIVE LIQUIDS

(75) Inventors: Paul R. Young, Wheaton, IL (US); Donovan Erickson, Cambridge, MN (US)

(73) Assignee: Global Process Technologies, Inc., St. Michael, MN (US)

( * ) Notice: Subject to any disclaimer, the term of this patent is extended or adjusted under 35 U.S.C. 154(b) by 271 days.

(21) Appl. No.: 12/412,610

(22) Filed: Mar. 27, 2009

(65) Prior Publication Data

US 2009/0260454 A1 Oct. 22, 2009

Related U.S. Application Data

(60) Provisional application No. 61/040,512, filed on Mar. 28, 2008.

(51) Int. Cl.

| | |
|---|---|
| ***G01F 1/58*** | (2006.01) |
| ***G01F 1/64*** | (2006.01) |
| ***C23F 11/00*** | (2006.01) |
| ***C23F 11/10*** | (2006.01) |
| ***C09K 15/06*** | (2006.01) |
| ***C09K 15/18*** | (2006.01) |

(52) U.S. Cl. ..... 73/861.12; 73/861.11; 73/861.13; 73/861.14; 422/7; 422/41; 252/387; 252/392; 252/394

(58) Field of Classification Search ..... 73/861.11, 73/861.12, 861.13, 861.14; 252/387, 392, 252/394; 44/445, 446, 451, 629; 422/7, 422/41

See application file for complete search history.

(56) References Cited

U.S. PATENT DOCUMENTS

| | | | | | |
|---|---|---|---|---|---|
| 2,771,417 | A | * | 11/1956 | Ryznar et al. | 422/16 |
| 4,209,411 | A | | 6/1980 | Winans et al. | |
| 4,282,007 | A | * | 8/1981 | Sung | 44/343 |
| 4,294,585 | A | * | 10/1981 | Sung | 44/343 |
| 4,328,003 | A | | 5/1982 | Ryer et al. | |
| 4,365,972 | A | * | 12/1982 | Sung et al. | 44/381 |
| 4,376,635 | A | * | 3/1983 | Sung | 44/343 |
| 4,504,278 | A | * | 3/1985 | Sung | 44/330 |
| 4,505,717 | A | * | 3/1985 | Sung | 44/330 |
| 4,556,460 | A | * | 12/1985 | Robertson et al. | 203/19 |
| 4,782,709 | A | * | 11/1988 | Goto et al. | 73/861.12 |
| 5,019,341 | A | | 5/1991 | Niu et al. | |
| 5,024,677 | A | | 6/1991 | Wang et al. | |
| 5,035,720 | A | * | 7/1991 | Weers | 44/343 |
| 5,080,686 | A | | 1/1992 | Garrecht et al. | |
| 5,244,809 | A | * | 9/1993 | Nowak | 436/56 |
| 6,156,082 | A | | 12/2000 | MacMillan et al. | |
| 7,666,312 | B2 | * | 2/2010 | Hicks | 210/746 |
| 2005/0144834 | A1 | * | 7/2005 | Jimeson et al. | 44/302 |
| 2005/0260554 | A1 | * | 11/2005 | Gaalswyk | 435/3 |
| 2009/0260454 | A1 | * | 10/2009 | Young et al. | 73/861.13 |

* cited by examiner

*Primary Examiner* — Joseph D Anthony

(74) *Attorney, Agent, or Firm* — Merchant & Gould P.C.

(57) ABSTRACT

The present invention relates to a method for inhibiting in a non-aqueous, non-conductive liquid. The present method also relates to a corrosion inhibitor that can be employed in such a liquid. The method can include measuring or detecting the present corrosion inhibitor with a magnetic flow meter.

18 Claims, No Drawings

METHODS AND COMPOSITIONS FOR INHIBITING CORROSION IN NON-AQUEOUS, NON-CONDUCTIVE LIQUIDS

CROSS-REFERENCE TO RELATED APPLICATIONS

This application claims benefit of Provisional Application No. 61/040,512, filed Mar. 28, 2008, which application is incorporated herein.

FIELD

The present invention relates to a method for inhibiting corrosion in a non-aqueous, non-conductive liquid. The present method also relates to a corrosion inhibitor that can be employed in such a liquid. The method can include measuring or detecting the present corrosion inhibitor with a magnetic flow meter.

BACKGROUND

Measuring the amount of corrosion inhibitor added to a non-aqueous, non-conductive liquid, such as ethanol, gasoline, or blends of gasoline and ethanol, can be a problem. Conventional corrosion inhibitors are also non-conductive. Thus, the content of non-conductive inhibitors in non-aqueous, non-conductive liquid cannot be measured by conventional methods. Conventional methods for measuring ingredients in flowing liquids employ apparatus such as a magnetic flow meter that require that the liquid have a conductivity greater than 5 microSiemens per centimeter.

The conversion of corn into fuel ethanol is gaining popularity. In the United States, more than 135 plants produce ethanol. Currently, many ethanol plants use magnetic flow meters to measure the flow of beer from the fermenter to the distillation columns. Magnetic flow meters work by applying a magnetic field to a metering tube, which results in a potential difference proportional to the flow velocity perpendicular to the flux lines. Magnetic flow meters can only measure the flow of fluids in which some solids are present or those having a high concentration of ions and generally do not work with non-aqueous solutions. Once distilled ethanol leaves the columns, a magnetic flow meter will not accurately measure flow because there are no solids present in the ethanol and ethanol has low conductivity.

Distilled ethanol is corrosive to metals and can cause mass change, pitting, or degradation of metal pipes, storage tanks, and gas tanks. Corrosion inhibitors are often added to ethanol following distillation to prevent this corrosion. Conventional corrosion inhibitors are non-conductive, are too viscous, can increase the viscosity of a non-aqueous, non-conductive liquids, such as ethanol, and can separate from such liquids.

Accordingly, there remains a need for corrosion inhibitors for non-aqueous, non-conductive liquids that can be detected by conventional apparatus.

SUMMARY

The present invention relates to a method for inhibiting corrosion in a non-aqueous, non-conductive liquid. The present method also relates to a corrosion inhibitor that can be employed in such a liquid. The method can include measuring or detecting the present corrosion inhibitor with a magnetic flow meter.

The present invention includes a method of measuring the amount of corrosion inhibitor in a conduit. This embodiment of the method can include flowing a polar corrosion inhibitor through the conduit and monitoring the flow of the polar corrosion inhibitor with a magnetic flow meter.

The present invention includes a method of measuring the flow of a corrosion inhibitor and/or the flow of an mixture containing a corrosion inhibitor and non-aqueous, non-conductive liquid, for example, ethanol. This embodiment of the method can include adding a polar corrosion inhibitor to the non-aqueous, non-conductive liquid. The flow of the corrosion inhibitor or of the mixture can then be measured with a conventional magnetic flow meter.

The present invention includes a method of inhibiting corrosion. The method includes adding a polar corrosion inhibitor to a non-aqueous, non-conducting liquid. This embodiment of the invention can include providing a polar corrosion inhibitor; adding the polar corrosion inhibitor to a non-aqueous, non-conducting liquid to produce a corrosion inhibited mixture; and measuring the flow of the corrosion inhibited mixture with a magnetic flow meter.

The present invention also provides a method for buffering the pHe of an ethanol composition by providing a polar corrosion inhibitor, adding the polar corrosion inhibitor to the ethanol composition, and buffering the ethanol composition to a desired pHe.

DETAILED DESCRIPTION

Definitions

As used herein, the phrase "non-aqueous, non-conductive liquid" refers to a liquid containing less than about 5 wt-% water and having a conductivity of less than about 10 microSiemens per centimeter. In an embodiment, the "non-aqueous, non-conductive liquid" contains less than about 1 wt-% water and having a conductivity of less than about 5 microSiemens per centimeter. In an embodiment, the non-aqueous, non-conductive liquid" contains less than about 0.8 wt-% water and having a conductivity of less than 3 microSiemens per centimeter. Examples of non-aqueous, non-conductive liquids include gasoline, aromatic solvents, ether-containing alcohols, ethanol, and blends of gasoline and ethanol.

As used herein, the term "pHe" refers to a measure of the acidity of ethanol. The pHe is analogous to, but not identical with, pH in aqueous systems. The pHe of a composition or solution is defined as the result of a measurement according to ASTM test method D 6423

The Present Methods

The present invention includes a method of measuring the flow of a corrosion inhibitor and/or the flow of an mixture containing a corrosion inhibitor and non-aqueous, non-conductive liquid, for example, ethanol. This embodiment of the method can include adding a polar corrosion inhibitor to the non-aqueous, non-conductive liquid. The flow of the corrosion inhibitor or of the mixture can then be measured with a conventional magnetic flow meter.

The present invention includes a method of measuring the amount of corrosion inhibitor in a conduit. This embodiment of the method can include flowing a polar corrosion inhibitor through the conduit and monitoring the flow of the polar corrosion inhibitor with a magnetic flow meter. For example, in an embodiment, as the present polar corrosion inhibitor flows through a tube, pipe, or any apparatus used to feed corrosion inhibitor into distilled ethanol, conventional magnetic flow meter can accurately measure the flow of the polar corrosion inhibitor through the apparatus.

The present invention also provides a method of measuring the flow of corrosion inhibitor with conductivity greater than 3 μS/cm by providing a polar corrosion inhibitor, measuring the corrosion inhibitor with a magnetic flow meter at or before an outlet, and adding the corrosion inhibitor to a non-aqueous, non-conducting liquid from the outlet. In an embodiment, the method includes measuring flow of the corrosion inhibitor in an ethanol plant and adding the polar corrosion inhibitor to ethanol after distillation but before storage. In an embodiment, the method includes measuring flow of the corrosion inhibitor at and adding the polar corrosion inhibitor to non-aqueous, non-conducting liquid held in a transport container. In an embodiment, the method includes measuring flow of the corrosion inhibitor at and adding corrosion inhibitor to a storage tank. In an embodiment, the method includes measuring flow of the corrosion inhibitor at and adding corrosion inhibitor to a transportation tank or pipe simultaneously with the non-aqueous, non-conducting liquid.

The present invention includes a method of inhibiting corrosion. The method includes adding a polar corrosion inhibitor to a non-aqueous, non-conducting liquid. This embodiment of the invention can include providing a polar corrosion inhibitor; adding the polar corrosion inhibitor to a non-aqueous, non-conducting liquid to produce a corrosion inhibited mixture; and, optionally, measuring the flow of the corrosion inhibitor with a magnetic flow meter.

In an embodiment, the method includes adding the polar corrosion inhibitor to ethanol after distillation and before storage. In an embodiment, the method includes adding the polar corrosion inhibitor to ethanol in a plant producing fuel ethanol. In an embodiment, the method includes adding the polar corrosion inhibitor to non-aqueous, non-conducting liquid held in a storage tank. In an embodiment, the method includes adding the polar corrosion inhibitor to an ethanol containing liquid in a distillery.

In an embodiment, the non-aqueous, non-conducting liquid has a conductivity of less than 3 μS/cm. The non-aqueous, non-conducting liquid can be ethanol. The ethanol can be about 190 proof ethanol or greater.

The present invention also provides a method for buffering the pHe of an ethanol composition by providing a polar corrosion inhibitor, adding the polar corrosion inhibitor to the ethanol composition, and buffering the ethanol composition to a desired pHe. In an embodiment, pHe is at a level that reduces corrosion.

The amount of corrosion inhibitor to add to ethanol is described by the NACE Standard of Testing Method TM-01-72. The standard requires that inhibitor treated ethanol be added to "E" rated gasoline. The resulting ethanol/gasoline blend must then rate "B+" or better in terms of corrosivity. Under this system, the lower the dose of inhibitor added to ethanol, the more effective the inhibitor is at limiting corrosivity.

Magnetic Flow Meters

A magnetic flowmeter, also known as an electromagnetic flowmeter or an induction flowmeter, is a volumetric flow meter which does not have any moving parts, which is conventionally used for a dirty or water based conductive liquid. A magnetic flowmeter does not measure flow in non-conductive and non-aqueous liquids such as hydrocarbons, distilled water, and many non-aqueous solutions. The operation of a magnetic flowmeter is based on Faraday's Law, which states that the voltage induced across any conductor as it moves at right angles through a magnetic field is proportional to the velocity of that conductor. Accordingly, the fluid to be measured with a magnetic flowmeter must be sufficiently electrically conductive, e.g., for the Faraday principle to apply.

As applied to the design of magnetic flowmeters, Faraday's Law indicates that signal voltage (E) is dependent on the average liquid velocity (V) the magnetic field strength (B) and the distance between the electrodes (D). In the case of wafer-style magnetic flowmeters, a magnetic field is established throughout the entire cross-section of the flow tube. If this magnetic field is considered as the measuring element of the magnetic flowmeter, it can be seen that the measuring element is exposed to the hydraulic conditions throughout the entire cross-section of the flowmeter.

A conventional magnetic flowmeter can include electric coils around/near the pipe of the flow to be measured and a pair of electrodes across the pipe wall or at the tip of the flowmeter. If the targeted fluid is electrically conductive, i.e., a conductor, its passing through the pipe is equivalent to a conductor cutting across the magnetic field. This induces changes in voltage reading between the electrodes. The higher the flow speed, the higher the voltage.

The present method can employ any of a variety commercially available magnetic flowmeters. Suitable flow meters include model FMH-401 from Omega Corporation.

Polar Corrosion Inhibitor

The present invention includes corrosion inhibitors that are effective in a non-aqueous, non-conductive liquid to reduce the corrosion resulting from contact with the liquid.

The present corrosion inhibitor can have a conductivity of above 5 microSiemens per centimeter. In an embodiment, the present corrosion inhibitor alters the properties of the non-aqueous, non-conductive liquid such that ions can separate in the altered liquid. Of course, this does not exclude the use of the corrosion inhibitors of the present invention to inhibit corrosion in liquids that are conductive and/or that include sufficient water that they are not considered non-aqueous.

In an embodiment, the present corrosion inhibitor includes an effective amount of a polar compound. The polar compound can be, for example, an alkyl alcohol, an aromatic alcohol, a glycol, a polymeric alcohol, an alkyl ether, a cyclic ether, an ether-containing alcohol, an ester, or a mixture thereof. Suitable glycols include ethylene glycol, propylene glycol, or a mixture thereof. Suitable ether containing alcohols include 2-butoxy ethanol, also known as butyl cellosolve. In an embodiment, the present corrosion inhibitor includes a glycol and an ether, for example an ether-containing alcohol. For example, such a composition can include ethylene glycol, propylene glycol, or a mixture thereof and 2-butoxy ethanol. Suitable amounts of polar compound in the present corrosion inhibitor include about 1 to about 50 wt-%, about 2 to about 30 wt-%, about 4 to about 20 wt-%.

The present polar corrosion inhibitor can also include any of a variety of corrosion inhibiting components, solvents, and the like. The present corrosion inhibitor can include an acid neutralizing amine and/or a film-forming amine. The acid neutralizing amine and/or film-forming amine can include an organic amine, an alkyl amine, an alkanol amine, a triazole, a mixture thereof, or a salt thereof. The present corrosion inhibitor can include a surface-active carboxylic acid, anhydride, or sulfonate. The surface-active carboxylic acid can include an alkyl carboxylic acid, an alkenyl carboxylic acid, an aromatic carboxylic acid, a mixture thereof, a salt thereof, or an anhydride or sulfonate thereof. The present corrosion inhibitor can include a phosphate, phosphonate, organophosphate, phosphate ester, or mixtures thereof. The phosphate, phosphonate, organophosphate, phosphate ester, or mixtures thereof can form stable surface layers on iron. The present corrosion inhibitor can include a polymer with strong affinity for metal surfaces to retard the corrosion reactions. The polymer can include a polymeric amine, a polymeric ester, a polymeric acid, a mixture thereof, or a salt thereof. The present corrosion inhibitor can include a solvent. The solvent can be or include an organic solvent, such as an aromatic organic solvent. Suitable aromatic organic solvents include petroleum distillates, aromatic solvents, and solvent naphtha.

Amounts of ingredients employed in embodiments of the present compositions include those described in Table A. These amounts and ranges of amounts can be modified by the term "about".

TABLE A

| (wt-%) | | | |
|---|---|---|---|
| Ingredient | A | B | C |
| Polar Compound | 1-50 | 2-30 | 4-20 |
| Amine | 10-17 | 10-17 | 10-17 |
| Aliphatic Acid Anhydride | 3-7 | 3-7 | 3-7 |
| Aromatic Solvent | 25-85 | 45-85 | 55-85 |

The present polar corrosion inhibitor can have any of a variety of properties including being free flowing, not undergoing phase changes or separation upon heating or cooling under ambient conditions, dispersing readily into the non-aqueous fluid, and being capable of being added to the non-aqueous fluid in a sufficiently precise and accurate dosage, or combination thereof. Providing a precise and accurate dosage can prevent too low a dosage that will not provide sufficient protection from corrosion and too high a dosage that will be costly and may lead to other problems, such as phase separation or incompatibility with materials contacting said non-aqueous fluid. In an embodiment, the corrosion inhibitor can, for example, inhibit corrosion and provide a conductivity greater than 5 microSiemens per centimeter in the non-aqueous, non-conductive liquid.

In an embodiment, the polar corrosion inhibitor comprises about 50 to about 60 wt-% aromatic solvent, about 10 to about 20 wt-% amine, about 3 to about 7 wt-% aliphatic acid anhydride, about 10 to about 15 wt-% butyl cellosolve, and about 10 to about 15 wt-% ethylene glycol. In another embodiment, the polar corrosion inhibitor, comprising about 55 to about 65 wt-% aromatic solvent, about 10 to about 15 wt-% amine, about 3 to about 7 wt-% aliphatic acid anhydride, about 10 to about 15 wt-% ethanol, and about 10 to about 15 wt-% ethylene glycol.

In an embodiment, the present polar corrosion inhibitor can effectively buffer a non-aqueous, non-conductive liquid to provide a desirable pH (e.g., pHe). Such a buffering polar corrosion inhibitor can, for example, provide a method to adjust pH (e.g., pHe). Buffering capacity also prevents acid formation in long term storage conditions. Low pH (e.g., pHe) can contribute to accelerated corrosion.

The composition can include any of a variety of commercially available aromatic solvents, which can be referred to as an aromatic hydrocarbon solvent. In an embodiment, the aromatic solvent has a flash point of about 150° F. (e.g., 151° F.). Such a solvent can have a boiling point range of from about 180° C. to about 210° C. Such an aromatic solvent can have specific gravity of about 0.9. In an embodiment, the aromatic solvent is a mixture of alkyl benzenes. The alkyl benzenes can, for example, have molecular weights of 120, 134, or 148 and a total number of carbon atoms attached to the benzene ring being 3, 4, or 5. Such alkyl benzenes include trimethyl benzene, ethyl benzene, dimethylethyl benzene, methyl propyl benzene, tetramethylbenzene, diethyl toluene, dimethylisopropyl benzene, and the like. Suitable aromatic solvents are available from Univar.

EXAMPLES

The present corrosion inhibitor compositions were made and evaluated for providing conductivity to non-aqueous, non-conductive liquids. A conventional corrosion inhibitor was tested and provided too little conductivity to the corrosive liquid. The content of this conventional corrosion inhibitor is shown below in Table 1.

TABLE 1

| Ingredient | Ingredient Type | Percent of Whole |
|---|---|---|
| SC-150 | Aromatic Solvent | 79 |
| DMAE | Amine | 12 |
| DDSA | Aliphatic Anhydride | 5 |
| PAMA | Polymer | 4 |

Experimental corrosion inhibitors were made and evaluated for providing conductivity to non-aqueous, non-conductive liquids. The content of these experimental corrosion inhibitors is shown below in Table 2.

TABLE 2

| | Experimental Corrosion Inhibitor | | | | | | | | | |
|---|---|---|---|---|---|---|---|---|---|---|
| Ingredient (wt-%) | C-654M | C-6561 | C-6562 | C-6563 | C-6564 | C-6565 | C-6566 | C-6567 | C-6568 | C-656 |
| Aromatic Solvent | 83 | 79 | 79 | 79 | 58 | 58 | 58 | 58 | 58 | 56 |
| Amine | 12 | 12 | 12 | 12 | 12 | 12 | 12 | 12 | 12 | 12 |
| Aliphatic Acid Anhydride | 5 | 5 | 5 | 5 | 5 | 5 | 5 | 5 | 5 | 5 |
| Caustic | | 4 | | | | | | | | |
| Acid | | | 4 | | | | | | | |
| Sulfonate | | | | 4 | | | | | | |
| Ethanol | | | | | 25 | | | 12.5 | 12.5 | |
| Ethylene Glycol | | | | | | 25 | | | 12.5 | 12.5 |
| Butyl Cellosolve | | | | | | | 25 | 12.5 | | 12.5 |
| N-Tallow Amine | | | | | | | | | | 2 |

SC-150 is one example of a suitable aromatic solvent. Dimethylethanolamine (DMAE), N-tallow amine, or a mixture thereof are examples of a suitable amine. Dodecenyl succinic anhydride (DDSA) is one example of a suitable aliphatic acid anhydride. Sodium hydroxide (NaOH) is one example of a suitable caustic. Dinonylnapthylsulfonic acid (DINNSA) is one example of a suitable acid. Hybase M14 is on example of a suitable sulfonate. Ethanol, ethylene glycol, or a mixture thereof are examples of suitable alcohols. Glycol ether is one example of a suitable butyl cellosolve, also known as 2-butoxy ethanol.

Some of the tested corrosion inhibitors separated into layers, which was unsatisfactory. Corrosion inhibitors C-6568 and C-656 were phase stable and provided sufficient conductivity to the composition in which it was inhibiting corrosion.

We claim:

1. A method of measuring the flow of polar corrosion inhibitor comprising:

providing a polar corrosion inhibitor; the polar corrosion inhibitor comprising:
about 4 to about 20 wt-% polar compound;
about 10 to about 17 wt-% amine;
about 3 to about 7 wt-% aliphatic anhydride; and
about 55 to about 85 wt-% aromatic solvent;

measuring the corrosion inhibitor with a magnetic flow meter at or before an outlet; and adding the measured corrosion inhibitor to a non-aqueous, non-conducting liquid from the outlet.

2. The method of claim 1, comprising adding the polar corrosion inhibitor to ethanol after distillation and before storage.

3. The method of claim 1, comprising adding the polar corrosion inhibitor to non-aqueous, non-conducting liquid held in a storage tank.

4. The method of claim 1, comprising adding the polar corrosion inhibitor to an ethanol containing liquid in a distillery.

5. A method of inhibiting corrosion:

providing a polar corrosion inhibitor; the polar corrosion inhibitor comprising:
about 1 to about 50 wt-% polar compound;
about 10 to about 17 wt-% amine;
about 3 to about 7 wt-% aliphatic anhydride; and
about 25 to about 85 wt-% aromatic solvent;

adding the polar corrosion inhibitor to a non-aqueous, non-conducting liquid to produce a corrosion inhibited mixture; and measuring the flow of the corrosion inhibited mixture with a magnetic flow meter.

6. The method of claim 5 wherein the non-aqueous, non-conducting liquid has a conductivity of less than 3 μS/cm.

7. The method of claim 5 wherein the non-aqueous, non-conducting liquid is ethanol.

8. The method of claim 5 wherein the non-aqueous, non-conducting liquid is 190 proof ethanol.

9. The method of claim 5, comprising adding the polar corrosion inhibitor to ethanol after distillation and before storage.

10. The method of claim 5, comprising adding the polar corrosion inhibitor to non-aqueous, non-conducting liquid held in a storage tank.

11. The method of claim 5, comprising adding the polar corrosion inhibitor to non-aqueous, non-conducting liquid in a transport vessel or pipe simultaneously with the non-aqueous, non-conducting liquid.

12. The method of claim 5, comprising adding the polar corrosion inhibitor to an ethanol containing liquid in a distillery.

13. The method of claim 1, wherein the polar corrosion inhibitor comprises:
about 55 to about 60 wt-% aromatic solvent;
about 10 to about 17 wt-% amine;
about 3 to about 7 wt-% aliphatic acid anhydride;
about 10 to about 15 wt-% butyl cellosolve; and
about 10 to about 15 wt-% ethylene glycol.

14. The method of claim 1, wherein the polar corrosion inhibitor comprises:
about 55 to about 65 wt-% aromatic solvent;
about 10 to about 15 wt-% amine;
about 3 to about 7 wt-% aliphatic acid anhydride;
about 10 to about 15 wt-% ethanol; and
about 10 to about 15 wt-% ethylene glycol.

15. The method of claim 1, wherein the polar corrosion inhibitor comprises:
56-58 wt-% aromatic solvent;
12 wt-% amine;
5 wt-% aliphatic acid anhydride; and
12.5 wt-% ethylene glycol.

16. The method of claim 5, wherein the polar corrosion inhibitor comprises:
about 50 to about 60 wt-% aromatic solvent;
about 10 to about 20 wt-% amine;
about 3 to about 7 wt-% aliphatic acid anhydride;
about 10 to about 15 wt-% butyl cellosolve; and
about 10 to about 15 wt-% ethylene glycol.

17. The method of claim 5, wherein the polar corrosion inhibitor comprises:
about 55 to about 65 wt-% aromatic solvent;
about 10 to about 15 wt-% amine;
about 3 to about 7 wt-% aliphatic acid anhydride;
about 10 to about 15 wt-% ethanol; and
about 10 to about 15 wt-% ethylene glycol.

18. The method of claim 5, wherein the polar corrosion inhibitor comprises:
56-58 wt-% aromatic solvent;
12 wt-% amine;
5 wt-% aliphatic acid anhydride; and
12.5 wt-% ethylene glycol.

* * * * *